US007895978B2

(12) United States Patent
Moss

(10) Patent No.: US 7,895,978 B2
(45) Date of Patent: Mar. 1, 2011

(54) NON-POLLUTING TWO-STROKE ENGINE WITH AIR-COOLED PISTON

(75) Inventor: Marlon Moss, Hollister, CA (US)

(73) Assignee: SoundStarts, Inc., Aromas, CA (US)

( * ) Notice: Subject to any disclaimer, the term of this patent is extended or adjusted under 35 U.S.C. 154(b) by 840 days.

(21) Appl. No.: 11/853,162

(22) Filed: Sep. 11, 2007

(65) Prior Publication Data

US 2010/0288252 A1 Nov. 18, 2010

Related U.S. Application Data

(60) Provisional application No. 60/844,190, filed on Sep. 12, 2006.

(51) Int. Cl.
*F02B 25/00* (2006.01)

(52) U.S. Cl. ..... 123/73 PP; 123/65 B; 123/65 BA; 123/193.1; 123/193.6; 123/193.2; 92/172; 92/255

(58) Field of Classification Search ..... 123/193.1, 123/193.2, 193.4, 193.6, 65 B, 65 BA, 65 P; 92/172, 255
See application file for complete search history.

(56) References Cited

U.S. PATENT DOCUMENTS 1,180,947 A * 4/1916 Scott ..... 92/45
1,297,350 A * 3/1919 Hinchliffe ..... 123/543
1,619,460 A * 3/1927 Cage ..... 123/69 V
1,632,984 A * 6/1927 Riehm ..... 123/61 R
1,932,332 A * 10/1933 Bernard ..... 123/71 VA
2,224,229 A * 12/1940 Miller ..... 123/65 S
2,359,672 A * 10/1944 Penco ..... 123/41.39
2,497,781 A * 2/1950 Logashkin ..... 123/41.35
2,746,446 A * 5/1956 Laubender ..... 123/193.2
4,282,837 A * 8/1981 Holtman et al. ..... 123/193.6
4,969,425 A * 11/1990 Slee ..... 123/73 AA
RE34,143 E * 12/1992 Rao et al. ..... 123/193.4

* cited by examiner

*Primary Examiner*—Michael Cuff
*Assistant Examiner*—Hung Q Nguyen
(74) *Attorney, Agent, or Firm*—Donald R. Boys; Central Coast Patent Agency, Inc

(57) ABSTRACT

A two-stroke internal combustion engine has at least one cylinder having a bore diameter, a piston slip-fit in the cylinder, the piston having an upper portion and a lower portion and a central portion of significantly less than the bore diameter, providing an annular space between the central portion and the cylinder wall, and an air pump providing air to one or more intake ports, wherein for a significant portion of every stroke both one or more exhaust ports and the one or more intake ports are open to the annular space between the central piston portion and the cylinder wall, allowing the air pump to force air from the one or more intake ports around the central piston portion to the one or more exhaust ports.

6 Claims, 2 Drawing Sheets

NON-POLLUTING TWO-STROKE ENGINE WITH AIR-COOLED PISTON

BACKGROUND OF THE INVENTION

1. Field of the Invention

The present invention is in the field of internal combustion engines, and pertains more particularly to two-stroke internal combustion engines.

2. Description of Related Art

There are many sorts of two-stroke internal combustion engines known in the art at the time of the present patent application, and all of similar operating characteristics and similar problems. One commonality is that oil to lubricate cylinder and bore needs to be mixed with the gasoline used for fuel, because in such engines the crank case volume is not completely sealed from the intake and exhaust. Another is that the pistons in such engines heat very rapidly due to the two-stroke duty cycle, with each cylinder firing with every stroke. Two-stroke engines, however, typically provide substantially higher torque and substantially more power than comparable-sized four-stroke engines, but suffer from lower reliability and service life than comparable four-stroke engines. Further the two-stroke, due to the oil mixture with the fuel, are significantly polluting engines.

What is clearly needed is a two-stroke engine with an oil-bathed crankcase and an improved system for cooling the pistons.

BRIEF SUMMARY OF THE INVENTION

In an embodiment of the present invention a two-stroke internal combustion engine is provided, comprising at least one cylinder having a bore diameter, a central axis, a cylinder wall, and an upper and a lower extremity, a piston slip-fit in the cylinder, the piston having an overall height and a top surface, an upper portion and a lower portion each of approximately the bore diameter, each of the upper and lower portions having at least one seal ring between the piston and the cylinder wall, and a central portion of significantly less than the bore diameter and a height at least one-half of the overall piston height, providing an annular space between the central piston portion and the cylinder wall, a crank mechanism coupled to the piston in a manner providing a repeating stroke of a specific stroke length in the direction of the central axis of the cylinder, the repeating stroke providing a varying volume V between the top of the cylinder and the top surface of the piston, one or more exhaust ports through the cylinder wall, each exhaust port having a first height in the direction of the cylinder axis, centered at a first dimension from the top of the cylinder, one or more intake ports through the cylinder wall, each intake port having a second height in the direction of the cylinder axis, centered at a second dimension from the top of the cylinder, and a forced-air mechanism providing air to the one or more intake ports. For a significant portion of every stroke both the one or more exhaust ports and the one or more intake ports are open to the annular space between the central piston portion and the cylinder wall, allowing the air pump to force air from the one or more intake ports around the central piston portion to the one or more exhaust ports.

In one embodiment of the engine a fuel injection system is provided to allow timed injections of fuel into the air provided by the forced-air mechanism at the one or more intake ports, the first height of the exhaust ports overlaps with the second height of the intake ports, and the first dimension is greater than the second dimension, such that at one position in an upstroke the upper portion of the piston closes the one or more exhaust ports while the one or more intake ports are still partially open, allowing fuel injection into the varying volume V.

In another embodiment the piston overall height, the stoke length, and the position of the ports provides for the one or more seal rings in the lower portion of the piston to traverse always between the lower extremity of the cylinder and a position below either the one or more intake ports or the one or more exhaust ports, allowing for the crank mechanism to be oil-bathed, and the two-stroke engine to be operated with gasoline not mixed with oil.

In still another embodiment the engine may be operated as a diesel engine, and in some embodiments there is a spark firing mechanism in the cylinder top for firing compressed air-fuel mixture in the varying volume V.

Also in some embodiments there is a wick ring in the upper portion of the piston, wherein the stroke length is such that at a lower extremity of the stroke the wick ring wipes a portion of the cylinder wall exposed at the upper portion of the stroke to the oil-bathed crank mechanism, such the wick ring approaching the upper extremity of the stroke provides oil to an upper portion of the cylinder wall never exposed in operation to the oil-bathed crank mechanism.

DETAILED DESCRIPTION OF THE INVENTION

Figure 1B:
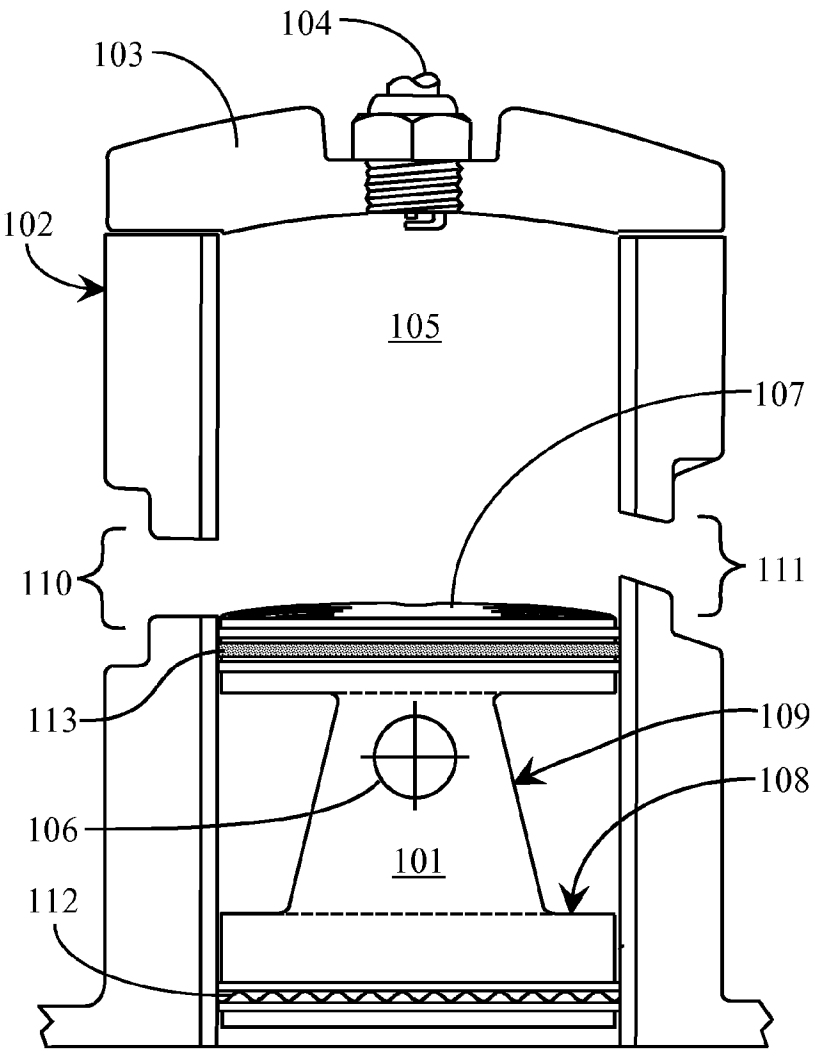
FIG. 1*b* is a sectioned illustration of an engine in an embodiment of the present invention with the piston substantially at bottom-dead-center.
Figure 1A:
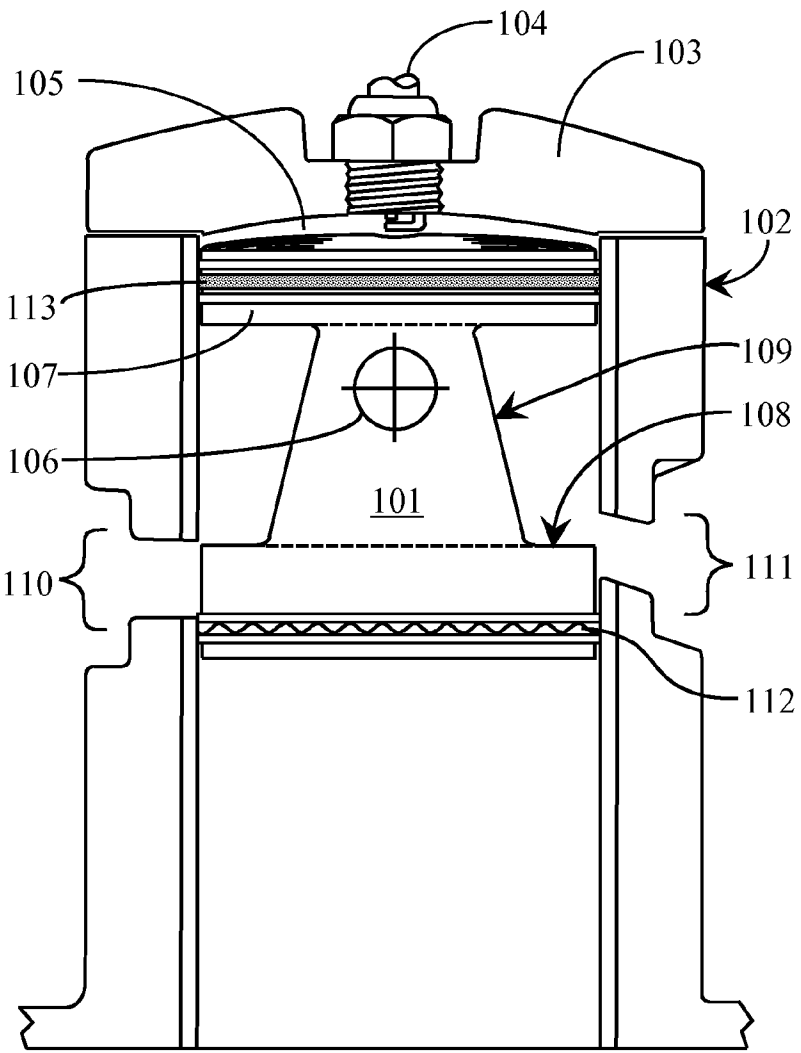
FIG. 1*a* is a sectioned illustration of an engine in an embodiment of the present invention with the piston substantially at top-dead-center.

Referring now to FIG. 1*a*, a piston 101 is shown in a cylinder 102 for an engine according to an embodiment of the present invention. Head 103 closes the cylinder, and spark-plug 104 provides spark to ignite compressed air/fuel mixture in volume 105, with piston 101 near top-dead-center. Connecting rod pin 106 is to join piston 101 to a connecting rod not shown.

Piston 101 has an upper portion 107 and a lower portion 108 both of a diameter to fit the diameter of the cylinder bore. A central portion 109, however, joins upper and lower portions 107 and 108 in the shape of a truncated cone diminishing in diameter toward the upper portion. The diameter of central portion 109 is everywhere substantially smaller than the bore diameter, creating substantial space between the central portion and any point on the cylinder inner wall.

An exhaust port 110 and an intake port 111 are strategically spaced and sized to provide, in conjunction with the piston design, for certain operating features more fully explained below. In the position shown piston lower portion 108 substantially blocks exhaust port 110 but not intake port 111. A high-capacity blower or air-pump (not shown in FIG. 1*a*) supplies cool air into the intake port on a continuing basis.

FIG. 1*b* is a cross section of the same engine as FIG. 1*a*, but with piston 101 near bottom-dead-center. In FIG. 1*b* the parts bear the same element numbers as in FIG. 1*a*. With the piston near bottom-dead-center as shown in FIG. 1*b* both the intake and the exhaust port are uncovered. Also, although not shown in detail in FIG. 1*a* and 1*b* the exhaust and the intake both have multiple openings from a manifold and passing through the cylinder wall around the diameter of the cylinder, providing for free and unimpeded flow of air, fuel and exhaust.

As the piston approaches the bottom-dead-center position on a power stroke as shown in FIG. 1*b*, at one point the upper piston portion 107 reaches the uppermost extent of the intake port. By this time the pressure in the cylinder, due to expanding volume, is reduced enough to limit backflow of exhaust into the intake manifold against the pressure provided by the air blower. As the piston continues its downward travel, the exhaust port is uncovered. Then as the piston continues down, and for a small portion of the next up-stoke the air blower or pump efficiently sweeps all combustion products from the cylinder volume into the exhaust manifold.

Figure 2B:
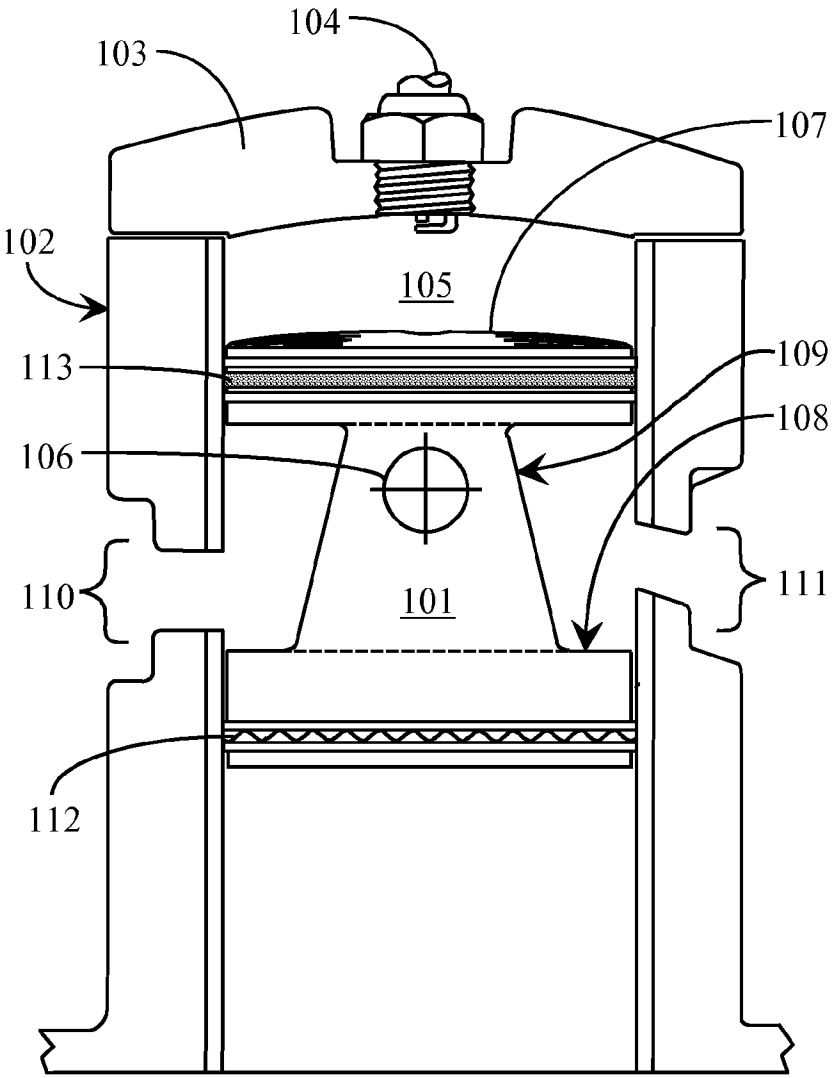
FIG. 2*b* is a sectioned illustration of an engine in an embodiment of the present invention with the piston on the up or the down-stroke, illustrating a way to air cool the piston.
Figure 2A:
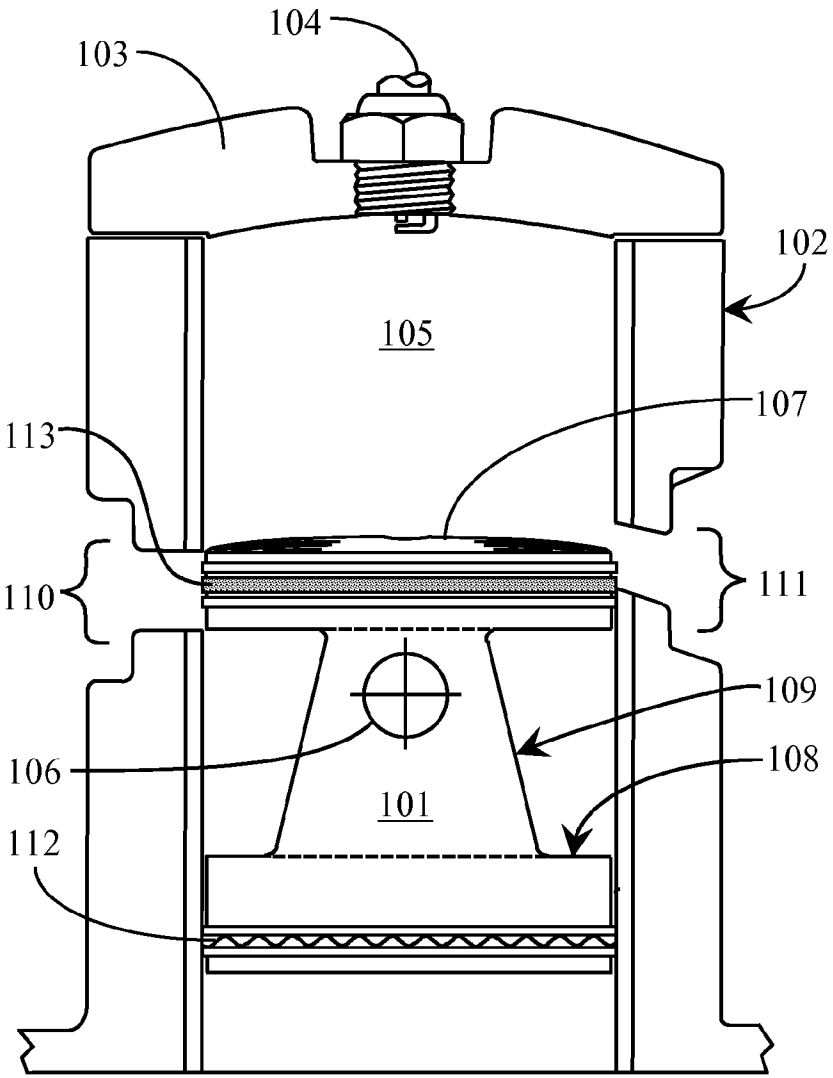
FIG. 2*a* is a sectioned illustration of an engine in an embodiment of the present invention with the piston on the up-stroke, having covered the exhaust port but not the intake port.

FIG. 2*a* illustrates the same engine as in FIGS. 1*a* and 1*b*, with piston 101 in a position on upstroke just at the point that the exhaust port becomes blocked, but the intake port is still partially open. At this position one or more fuel injectors positioned just outside the cylinder inject fuel (no oil mixture in the fuel) into the stream of air entering the volume 105. In some cases the fuel may begin to be injected just before the exhaust is entirely closed. A timing mechanism is used to time the fuel injection to be appropriate under different conditions, such as higher engine RPM or maximum power required. As the piston continues upstroke the intake valve closes to the volume 105 and compression begins, and continues until the spark plug fires near top-dead-center.

FIG. 2*b* illustrates the same piston further in the compression stroke, or at the same position on the power stroke. For a long portion of both the compression stroke and the power stroke the volume around central portion 101 of the piston is swept by cooling air driven by the air blower or pump through the intake port and out the exhaust port. This provides for significant cooling of the piston not available in other two-stroke engines.

Referring again to FIGS. 1*a* and 1*b*, a piston compression ring 113 is shown around the lower piston portion 108, and the design and the stroke is such that the crankcase is always isolated from the intake and exhaust ports and from volume 105. The crankcase can thus be oil-carrying, and may have conventional four-stroke style oil splash and delivery features. Oil is thus provided to the lower portion of the cylinder bore up to about just below the intake and exhaust ports. A wick ring 113 is provided at upper portion 107 of the piston, and in the lower extremities of travel of the piston, this wick ring wipes oil from the lower part of the cylinder bore, so as the piston travels upward, oil is provided the cylinder bore above the intake and exhaust ports.

Following the descriptions provided above, using the various drawings provided, a two-stroke internal combustion engine according to an embodiment of this invention may have at least one cylinder having a bore diameter, a central axis, a cylinder wall, and an upper and a lower extremity, and a piston slip-fit in the cylinder, the piston having an overall height and a top surface, an upper portion and a lower portion each of approximately the bore diameter, each of the upper and lower portions having at least one seal ring between the piston and the cylinder wall, and a central portion of significantly less than the bore diameter and a height at least one-half of the overall piston height, providing an annular space between the central piston portion and the cylinder wall. There may also be a crank mechanism coupled to the piston in a manner providing a repeating stroke of a specific stroke length in the direction of the central axis of the cylinder, the repeating stroke providing a varying volume V between the top of the cylinder and the top surface of the piston, one or more exhaust ports through the cylinder wall, each exhaust port having a first height in the direction of the cylinder axis, centered at a first dimension from the top of the cylinder, and one or more intake ports through the cylinder wall, each intake port having a second height in the direction of the cylinder axis, centered at a second dimension from the top of the cylinder. There may further be a forced-air mechanism providing air to the one or more intake ports, and for a significant portion of every stroke both the one or more exhaust ports and the one or more intake ports may be open to the annular space between the central piston portion and the cylinder wall, allowing the air pump to force air from the one or more intake ports around the central piston portion to the one or more exhaust ports.

The engine in an embodiment of the invention may also have a fuel injection system to provide timed injections of fuel into the air provided by the forced-air mechanism at the one or more intake ports, and the first height of the exhaust ports may overlap with the second height of the intake ports, and the first dimension is greater than the second dimension, such that at one position in an upstroke the upper portion of the piston closes the one or more exhaust ports while the one or more intake ports are still partially open, allowing fuel injection into the varying volume V.

In some engines according to the invention the piston overall height, the stoke length, and the position of the ports provides for the one or more seal rings in the lower portion of the piston to traverse always between the lower extremity of the cylinder and a position below either the one or more intake ports or the one or more exhaust ports, allowing for the crank mechanism to be oil-bathed, and the two-stroke engine to be operated with gasoline not mixed with oil. Such an engine may be operated either as a diesel engine or as a spark-filed engine.

In some such engines there may be a wick ring in the upper portion of the piston, wherein the stroke length is such that at a lower extremity of the stroke the wick ring wipes a portion of the cylinder wall exposed at the upper portion of the stroke to the oil-bathed crank mechanism, such the wick ring approaching the upper extremity of the stroke provides oil to an upper portion of the cylinder wall never exposed in operation to the oil-bathed crank mechanism.

Some examples have been provided of the elements and practice of the present invention, but there are many changes that might be made that will fall within the spirit and scope of the invention. For example, there may be more than one compression ring and more than one wick ring per piston. Many materials may be suitable for different parts of the engine, and dimensions may vary widely. Engines may be built incorporating these inventive features having multiple cylinders arranged in many different ways, such as in-line or V. Diesel versions may be provided as well by adjusting the stroke and compression and eliminating the spark plug. There are many other such changes that may be made within the spirit and scope of the invention. The invention is limited only by the scope of the claims that follow.

The invention claimed is:

1. A two-stroke internal combustion engine comprising:

at least one cylinder having a bore diameter, a central axis, a cylinder wall, and an upper and a lower extremity;

a piston slip-fit in the cylinder, the piston having an overall height and a top surface, an upper portion and a lower portion each of approximately the bore diameter, each of the upper and lower portions having at least one seal ring between the piston and the cylinder wall, and a central portion of significantly less than the bore diameter and a height at least one-half of the overall piston height, providing an unobstructed annular volume between the central piston portion and the cylinder wall;

a crank mechanism coupled to the piston in a manner providing a repeating stroke of a specific stroke length in the direction of the central axis of the cylinder, the repeating stroke providing a varying volume V between the top of the cylinder and the top surface of the piston;

one or more exhaust ports through the cylinder wall, each exhaust port having a first height in the direction of the cylinder axis, centered at a first dimension from the top of the cylinder;

one or more intake ports through the cylinder wall, each intake port having a second height in the direction of the cylinder axis, centered at a second dimension from the top of the cylinder; and a forced-air mechanism providing air to the one or more intake ports;

wherein for a significant portion of every stroke both the one or more exhaust ports and the one or more intake ports are open to the unobstructed annular volume between the central piston portion and the cylinder wall, allowing the forced-air mechanism to force air freely and without obstruction from the one or more intake ports around the central piston portion to the one or more exhaust ports.

2. The engine of claim 1 further comprising a fuel injection system to provide timed injections of fuel into the air provided by the forced-air mechanism at the one or more intake ports, and wherein the first height of the exhaust ports overlaps with the second height of the intake ports, and the first dimension is greater than the second dimension, such that at one position in an upstroke the upper portion of the piston closes the one or more exhaust ports while the one or more intake ports are still partially open, allowing fuel injection into the varying volume V.

3. The engine of claim 2 wherein the piston overall height, the stroke length, and the position of the ports provides for the one or more seal rings in the lower portion of the piston to traverse always between the lower extremity of the cylinder and a position below either the one or more intake ports or the one or more exhaust ports, allowing for the crank mechanism to be oil-bathed, and the two-stroke engine to be operated with gasoline not mixed with oil.

4. The engine of claim 1 operated as a diesel engine with compression firing.

5. The engine of claim 2 further comprising a spark firing mechanism in the cylinder top for firing compressed air-fuel mixture in the varying volume V.

6. The engine of claim 3 further comprising a wick ring in the upper portion of the piston, wherein the stroke length is such that at a lower extremity of the stroke the wick ring wipes a portion of the cylinder wall exposed at the upper portion of the stroke to the oil-bathed crank mechanism, such the wick ring approaching the upper extremity of the stroke provides oil to an upper portion of the cylinder wall never exposed in operation to the oil-bathed crank mechanism.

* * * * *